US009220964B2

(12) United States Patent
Skinner

(10) Patent No.: US 9,220,964 B2
(45) Date of Patent: Dec. 29, 2015

(54) METHOD OF USING THROWING TRAINING DEVICE

(71) Applicant: John Skinner, Wethersfield, CT (US)

(72) Inventor: John Skinner, Wethersfield, CT (US)

( * ) Notice: Subject to any disclaimer, the term of this patent is extended or adjusted under 35 U.S.C. 154(b) by 17 days.

(21) Appl. No.: 14/186,662

(22) Filed: Feb. 21, 2014

(65) Prior Publication Data

US 2014/0171227 A1 Jun. 19, 2014

Related U.S. Application Data

(62) Division of application No. 13/134,302, filed on Jun. 3, 2011, now abandoned.

(51) Int. Cl.

| | |
|---|---|
| ***A63B 69/00*** | (2006.01) |
| ***A63B 65/00*** | (2006.01) |
| *A63B 71/06* | (2006.01) |

(52) U.S. Cl.

CPC ..... *A63B 69/0059* (2013.01); *A63B 65/00* (2013.01); *A63B 2069/0006* (2013.01); *A63B 2071/0694* (2013.01); *A63B 2209/10* (2013.01); *A63B 2220/20* (2013.01); *A63B 2225/09* (2013.01)

(58) Field of Classification Search

USPC ..... 473/458, 453, 206; 482/131, 126, 125, 482/124; 2/69

See application file for complete search history.

(56) References Cited

U.S. PATENT DOCUMENTS

| | | | | |
|---|---|---|---|---|
| 483,642 | A * | 10/1892 | Behmer | 33/514.2 |
| 1,623,138 | A | 4/1927 | Swift | |
| 1,655,092 | A | 1/1928 | Davis | |
| 2,205,626 | A | 6/1940 | Mason | |
| 2,616,419 | A | 11/1952 | Karfiol | |
| 3,601,896 | A | 8/1971 | Ledene | |
| 4,019,734 | A * | 4/1977 | Lee et al. | 482/125 |
| 4,273,328 | A | 6/1981 | Ozbey et al. | |
| 4,377,284 | A | 3/1983 | Okerlin | |
| 4,544,155 | A | 10/1985 | Wallenbrock et al. | |
| 4,757,995 | A | 7/1988 | Gallagher | |
| 4,960,280 | A | 10/1990 | Corder, Jr. | |
| 5,005,833 | A | 4/1991 | Groveman et al. | |
| 5,012,821 | A | 5/1991 | Tarver | |
| 5,263,917 | A | 11/1993 | Ybarra et al. | |
| 5,704,856 | A * | 1/1998 | Morse | 473/422 |
| 5,807,218 | A | 9/1998 | Nagatomo | |
| 5,921,903 | A | 7/1999 | Lawrence | |
| 5,938,548 | A * | 8/1999 | Upshaw | 473/453 |
| 6,322,462 | B1 | 11/2001 | Kafer | |

(Continued)

OTHER PUBLICATIONS

Webpage download, Youtube2009, 2009, www.youtube.com/watch?v=GeM-jxXren4, 5 pages.*

(Continued)

*Primary Examiner* — Gene Kim

*Assistant Examiner* — M Chambers

(74) *Attorney, Agent, or Firm* — Alix, Yale & Ristas, LLP

(57) ABSTRACT

Disclosed herein is a throwing trainer comprising first and second bands configured to be removably attached to right and left forearms of a user, and an elongated, flexible, adjustable-length connector mounted to the first and second bands, the length of the connector being configured to limit the separation distance between the forearms of the user during wind-up for an overhand throw. A device assembly including a measuring tool and a method of practicing throwing also are disclosed.

11 Claims, 4 Drawing Sheets

(56) References Cited

U.S. PATENT DOCUMENTS

| | | | |
|---|---|---|---|
| 6,725,865 | B2 | 4/2004 | Chapman |
| 6,896,631 | B1 | 5/2005 | Fairchild |
| 7,374,502 | B2 | 5/2008 | Comello, Jr. |
| 7,445,569 | B2 | 11/2008 | Comello, Jr. |
| D590,038 | S | 4/2009 | Jarosik et al. |
| D606,602 | S | 12/2009 | Marotta |
| 7,686,745 | B2 | 3/2010 | Koch |
| 7,811,185 | B1 | 10/2010 | Reynolds |
| 8,007,413 | B1 | 8/2011 | Wu |
| 8,343,018 | B2 | 1/2013 | Moulton |
| 2004/0058757 | A1* | 3/2004 | Gray ..... 473/458 |
| 2010/0281600 | A1* | 11/2010 | Tagg ..... 2/171 |
| 2012/0309567 | A1* | 12/2012 | Skinner ..... 473/458 |

OTHER PUBLICATIONS

Webpage download, momsteam2010, 2010, web.archive.org/web/20100215000000*/http://www.momsteam.com/sports/youth-baseball-pitching-teaching-proper-mechanics-critical, 8 pages.*

Webpage download, youtube2011, 2011, https://www.youtube.com/watch?v=pgCue5wPfUs, 3 pages.*

* cited by examiner

METHOD OF USING THROWING TRAINING DEVICE

BACKGROUND

When a baseball or softball player throws a ball at full force, there is a tremendous amount of pressure on both the elbow and shoulder joints. For example, a 85 mile per hour pitch typically generates over 350 pounds per square inch (p.s.i.) of pressure on the shoulder area. Many amateur and professional pitchers throw a ball in a manner that creates unnecessary strain on the shoulder and elbow joints by leading with the elbow and snapping the arm through the throwing motion. Injuries commonly occur when users fly out their front side (shoulder and elbow). This action forces the throwing elbow to drop and be subject to the greatest risk of injury.

The pinching of the scapula while throwing is called "Scapular Loading." This action is dangerous for ball players, particularly youth who continue to grow. Scapular loading occurs when a person clamps their shoulder blades together at the separation point and over-extends their rotator cuff, causing damage to the throwing elbow. Due to the lack of stability in the shoulder area, the strain will trickle down and most likely build up in the elbow/forearm area, possibly leading to need for UCL surgery, also known as "Tommy John Surgery." A number of professional and amateur pitchers who throw using the technique of scapular loading have required Tommy John Surgery. With the throwing injury statistics increasing year after year, young ball players from the age range of 16 to 22 are requiring this surgery at a surprisingly high rate.

It would be useful to develop a tool that will reduce the frequency of, or prevent, throwing and pitching injuries and as a result, reduce the need for shoulder and elbow surgeries due to incorrect throwing mechanics.

SUMMARY

One embodiment described herein is a throwing trainer comprising first and second bands configured to be removably attached to right and left forearms of a user, and an elongated, flexible, adjustable-length connector mounted to the first and second bands, the length of the connector being configured to limit the separation distance between the forearms of the user during wind-up for an overhand throw.

Another embodiment is a throwing trainer assembly comprising a throwing trainer including first and second bands configured to be removably attached to right and left forearms of a user, and an elongated, flexible, adjustable-length connector mounted to the first and second bands, the length of the connector being configured to limit the separation distance between the forearms of the user during wind-up for an overhand throw, and a measuring device configured for use in measuring an appropriate connector length for the user.

A further embodiment is a method of practicing throwing, comprising fastening opposite ends of a connector to left and right forearms of a thrower, the connector having a length appropriate to press against the user's body at or near the collar bone if the thrower moves both arms behind the plane of their pectoral muscles during wind-up for an overhand throw.

DETAILED DESCRIPTION

As used herein, the term "throwing trainer" refers to a device used for practicing overhand throwing. The "length of the connector" refers to the distance between the locations on the connector that are mounted to first and second bands when the connector is pulled taut. The length of the connector determines the separation distance between the bands. The "plane of a user's pectoral muscles" refers to a plane extending vertically through the user's pectoral muscles at the vertical center of the muscles.

Figure 1:
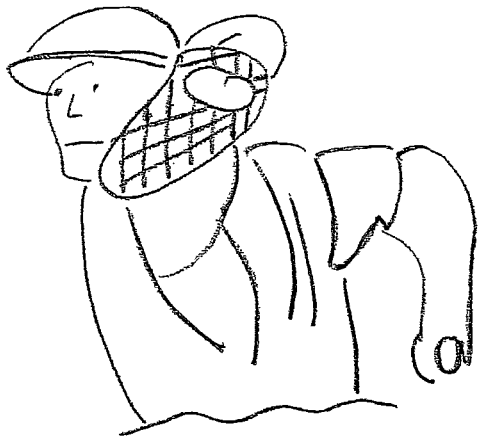
FIG. 1 schematically shows an incorrect throwing technique in which the player's elbows are behind their shoulders.

Referring to the drawings and first to FIG. 1, a baseball player that is using an unsafe, injury-causing throwing technique for pitching is illustrated. The player's rotator cuff is over-extended. Over time, this movement will cause strain to build up in the elbow and/or forearm.

Figure 2:
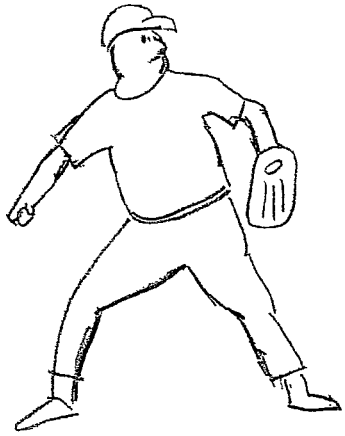
FIG. 2 schematically shows a correct throwing technique.

Referring to FIG. 2, a baseball player using a safe and correct wind-up is shown. Both of the player's elbows are lined up with his pectoral muscles and therefore he is not "Scapular Loading." The wind-up action used by this player keeps his elbows from moving behind his back and prevents his right elbow from leading the arm through the throw.

Figure 3:
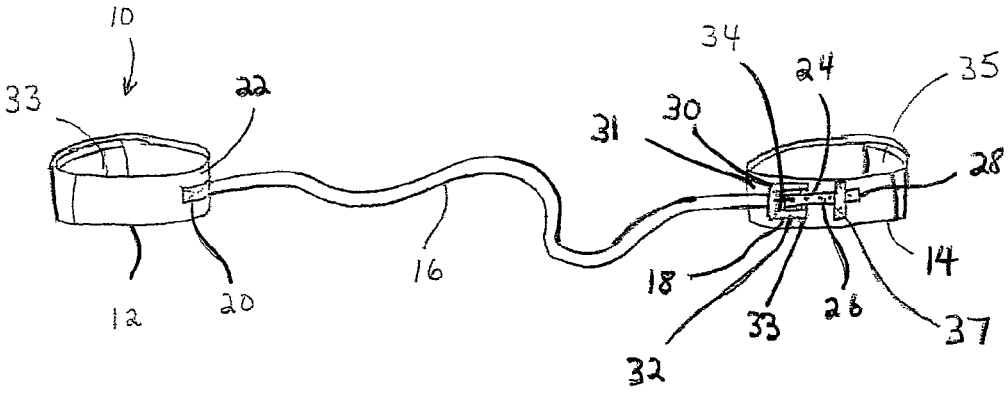
FIG. 3 shows a perspective view of the throwing training device.

Referring to FIG. 3, a throwing training device is shown and is designated as 10. The device includes a first band 12 configured to be removably fastened to one forearm of a user near the elbow, and a second band 14 configured to be removably fastened to the other forearm of the user near the elbow. An elongated, flexible connector 16, such as a strap, rope, cord or the like, extends from the first band 12 and the second band 14. The length of the connector 16 can be adjusted using a suitable type of fastener 18, such as a buckle-style fastener shown in FIG. 3. In the embodiment shown, a first end 20 of the connector 16 is permanently mounted to the outer surface 22 of the first band 12 with fastening tape, stitching or the like. The second end portion 24 has a series of aligned eyelets or apertures 26 formed therein in a belt-style arrangement, and terminates at a second end 28, enabling it to be removably mounted to the second band 14.

In the embodiment of FIG. 3, the fastener 18 is a buckle 30, which is mounted to the outer surface 31 of the second band 14. The buckle can be a prong-containing buckle, a buckle slide, a side release buckle, a double D fastener, or any other suitable buckle-type fastener. In the embodiment shown in FIG. 3, the buckle has a rectangular frame 32 with a central bar 33 that supports a prong 34 in place. The prong 34 fits through aperture 26 in the connector 16 in order to adjust the length of the connector 16. The outer surface 31 of the second band 14 has fastening tape (not shown), such as a closed loop hook style material (e.g. Velcro®), formed thereon. Additionally, or as an alternative, a loop 37 is included to hold the second end 28 of the strap 16 in place around the band 14. If the outer surface 31 of the second band 14 has fastening tape thereon, the under side of the second end portion 24 of the connector 16 also typically has a segment of fastening tape, such as Velcro®, formed thereon near the second end 28 that is configured to be removably mounted on the fastening tape on the outer surface 31 of the second band 14. This arrangement enables the portion of the connector that extends beyond the buckle to remain in place while the training device is used.

Figure 4:
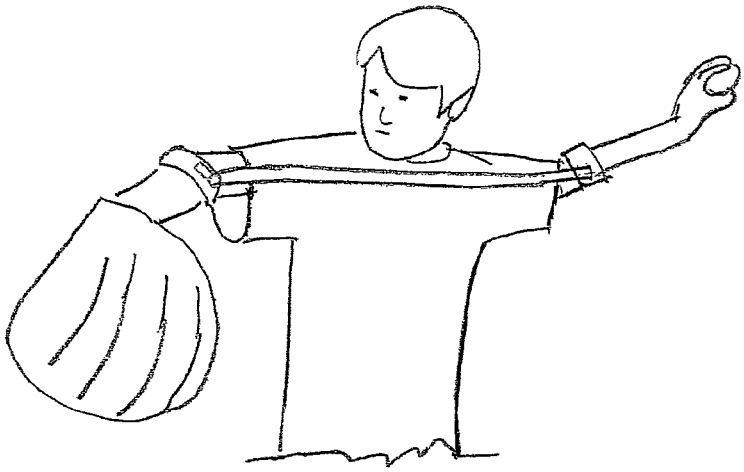
FIG. 4 shows a side view of the throwing training device shown in FIG. 3 when the device is fastened to the forearms of a user.

The perimeters of the bands 12, 14 are adjustable depending upon the size of the forearms of the user, and the bands 12, 14 are mounted to be snug against the user's forearm adjacent the elbow without restricting blood circulation, as shown in FIG. 4. While any suitable adjustable fastening mechanism can be used to mount the bands on the forearms of the user as long as the separation distance between the bands can be adjusted, fastening tape is preferred for its ease of mounting and removal and when used, forms overlapping regions 33, 35 on the bands 12, 14, respectively.

Figure 5:
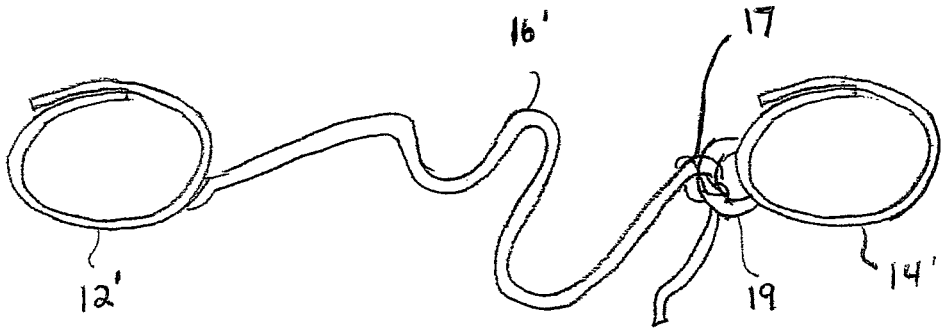
FIG. 5 shows an embodiment with a different type of length adjustment mechanism.

FIG. 5 shows another length adjustment mechanism for a connector 16' that is configured as a cord. In this embodiment, the connector 16' is permanently fastened to band 12' by stitching or the like, and the effective length of the connector 16' (defined by the separation distance between the bands when the connector 16' is taut) is adjusted by tying or untying one or more knots 17 near band 14' around a mounting loop 19, formed on band 14'. More specifically, the length of the connector 16' can be adjusted by tying one or more knots in the connector to shorten it, or moving previously tied knots to lengthen it. It is preferred that the connector 16' not be permanently fastened to the bands from both ends, because in some cases after the throw, the user's arms might separate in an amount that will cause the removable end of the strap to be removed from the band in order for the user to maintain balance, or brace a fall if the user loses his/her balance.

In other embodiments (not shown), both ends of the connector 16 are removably mounted to the bands 12, 14. This construction provides for ease in manufacturing and packaging devices of different sizes, as bands having the same length can be packaged with connectors or different lengths.

In one embodiment, the bands are removably fastened around the forearms of the user using fastening tape such as Velcro. In another embodiment (not shown) the bands are removably fastened at one or both terminal ends to the bands 12, 14 by double D type fasteners, or other mechanical fasteners. In all embodiments, the fasteners typically are made from strong plastic, rubber or metal.

If the connector has a flat, belt-type configuration, it typically is made of polyester, nylon, canvas or any other synthetic, natural or composite textile that is durable enough to endure repetitive use for all types of users and strength levels. In embodiments in which the connector 16 has a flat, belt-type shape, it has a length of about 20 to about 36 inches, or about 24 to about 32 inches, and a width of about ¼ to about 1 inches, or about ¼ to about ¾ inches. The thickness of the belt-shaped connector 16 typically is about 1/16 to about 3/16 inches. If the connector is a cord, it typically has a circular cross section with a diameter of about ⅛ to about ½ inches, or about ¼ to about ½ inches, and a length of about 20 to about 36 inches, or about 24 to about 32 inches. While the connector usually is generally inelastic, a somewhat elastic connector also can be employed.

The bands 12, 14 each typically have a width of about 1 to about 4 inches, or about 2 to about 3 inches, and a length of about 16 to about 24 inches so that the bands can be fastened around the forearms of the user with about 4-8 inches, or about 4-7 inches of overlap if fastening tape is used. Non-limiting examples of materials useful in making the bands include textiles such as polyester, nylon, canvas or any other synthetic, natural or composite textile that is durable enough to endure repetitive use.

Figure 6:
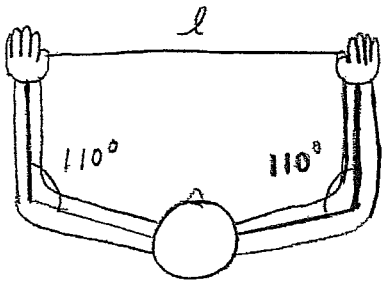
FIG. 6 is a schematic top plan view depicting the geometry of a user when adjusting the connector length for the throwing training device of FIG. 3.

To use the throwing training device, the bands are mounted on the left and right forearms of the user by each elbow with a size adjustable connector linking the bands, as shown in FIG. 4. Both elbows should be slightly in front of the shoulders and the hands directly pointed straight ahead when the chord is taut. To set the correct length for the connector, the user's hands are held directly in front of the body at the same height as the shoulders in the manner shown in FIG. 6. The user's shoulders are positioned to produce an angle of about 100-120 degrees, or about 105-115 degrees, or about 110 degrees, as shown in FIG. 6, between the upper arm and the forearm, with the forearms being parallel to one another and the elbows being elevated to shoulder height, slightly in front of the plane of the shoulders. The hands of the user are directly in front of the elbows at the same height as the elbows, palms down. The length of the connector is adjusted so that it is taut, running across the clavicle bone (collar bone) but not touching the chest area. There should be a distance of about one finger width between the connector and the user's body. If the user positions their arms to be no further apart than is permitted when wearing the throwing trainer, the user will be required to throw with leverage instead of using his/her ligaments and tendons.

When beginning the throw, the connector will start in a slack position when the hands are together in the glove. Upon separation of the hands, the elbows will separate while staying in front of the user's chest arriving at the wind-up or "Throwing/ Power Position". During the separation of the elbows, when done correctly, the connector will become tight between the elbows without catching the user's abdomen, rib cage or collar bone area. If the connector catches on the abdomen, rib cage or collar bone area, that result indicates that the user is separating improperly from the breaking of the hands. At that point, the user will be able to stop the throw and reset into a proper separation before any torque is applied to the body/arm area. It is ill-advised to stop a throw after the torque has occurred because this will cause injury to the arm area.

When the user's arms are properly positioned for the throw, the glove hand is positioned the same height, but about 105-115 degrees, or about 110 degrees, from the shoulder with the palm facing the target as well. The throwing arm is positioned with the ball facing backward (hand above the head with the elbows spread to the width of the size adjustable chord) and the throwing elbow inside the throwing shoulder. The length of connector is configured to match the distance between the two inner parts of the elbow bend area where the connector is attached to the bands. When the throw is mechanically correct, the connector does not contact the thrower around the collar bone area.

Assuming that the length of the connector has been correctly set, once the separation is at the most "allowed" position by the throwing training aid, i.e. when the connector is taut, a throw by the user from this position will not result in "Scapular Loading." Instead, the connector will promote proper separation and arm path for the wind-up and the resulting throw will not be unsafe for the user.

Figure 7:
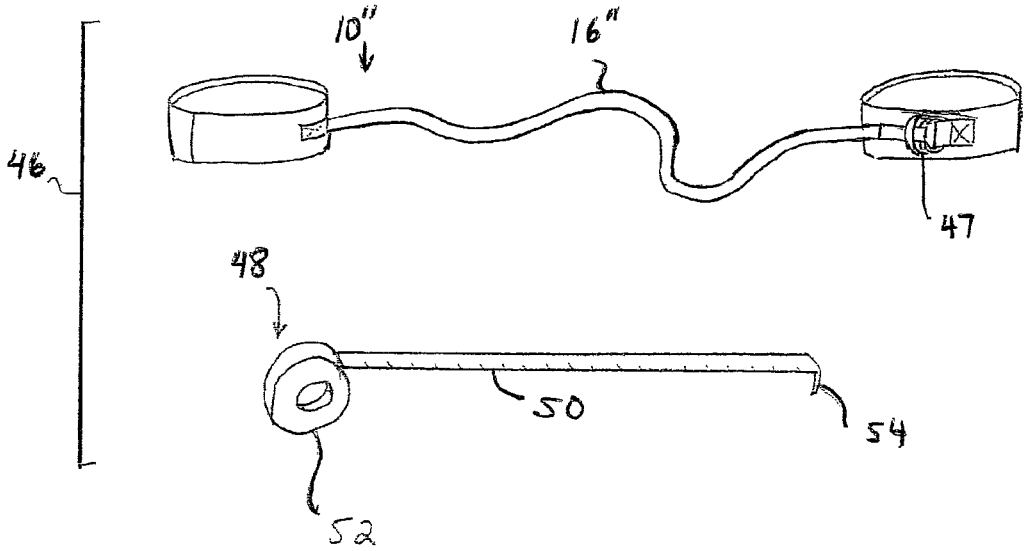
FIG. 7 shows a throwing training assembly including a training device and a measuring device used to determine the correct length for the connector.

FIG. 7 illustrates a throwing training assembly 46 including a throwing training device 10" in conjunction with a measuring device 48 that will facilitate the user's selection of the correct length for the connector. The throwing training device 10" includes first and second bands 12", 14", respectively, and a connector 16". The connector 16" is fixed to the first band 12" and is adjustably fastened to the second band 14" with a double D loop 47. The measuring device includes a roll-up measuring tape 50 in a tape compartment 52 sized to be held in a user's hand. The terminal end of the tape has a thumb-receiving portion 54, such as a thumb hook (or closed loop) configured to be hooked around (or surround) the thumb of the user's hand that is not holding the measuring tape compartment 52 when a measurement is made. To determine the proper length of the connector 16" when using the measuring device with the thumb hook, the user holds the tape measure in one hand and places the thumb receiving portion 54 around the thumb of the other hand, with both palms facing down. With the thumb hook or loop in place, the user moves his/her arms to the position shown in FIG. 6, with the arms parallel to both and ground and to each other, with an angle of about 100-120 degrees, or about 110 degrees between the upper arm and forearm. The user reads the number on the measuring tape next to the compartment. The user then adjusts the connector 16 so that the distance between the first band 12" to the second band 14" (at the closest point) when the connector 16" is taut equals the measured length. In some cases, the connector 16" has measurement indicia displayed thereon, in which case the length of the connector is adjusted such that the measurement indicia is consistent with the measured length using the measuring tape 50.

For all embodiments of the throwing training device, from the "set position" or wind-up position for the user, the user or coach will be able to map correct arm paths, and as a result the user will gain muscle memory. When throwing properly, the user's lead shoulder is pointed to the target with their elbows slightly in front (closed) of their shoulders. Once the rotation of the core area of the body occurs and the throw begins, there will be slack in the line. The user's front arm/shoulder does not pull backward, and therefore they will have full range of motion to throw. However, if the line is tight throughout the delivery, or if the connector catches the user's rib cage upon setting up to throw as indicated above, the user receives instant feedback that the throwing mechanics are incorrect.

If the user is throwing properly, he/she will not be inclined to stop a throw in the middle of the throw. The user's awareness of incorrect throwing form will cause them to feel the discomfort mid-throw when incorrect throwing mechanics are being used. As a result, the user will be able to erase bad muscle memory, or prevent incorrect muscle memory from developing in the first place.

The training device reduces strain on the user's shoulder and elbow region by comfortably enforcing body leverage and positive muscle memory through guided repetition. The device also helps increase velocity and minimizes the user's effort to throw at maximum speed. Proper use of this tool eliminates "Scapular Loading" and prevents related injuries that otherwise can result from incorrect pitching form.

It will be appreciated that various of the above-disclosed and other features and functions, or alternatives thereof, may be desirably combined into many other different systems or application. Various presently unforeseen or unanticipated alternatives, modifications, variations, or improvements therein may be subsequently made by those skilled in the art which are also intended to be encompassed by the following claims.

What is claimed is:

1. A method of practicing the throwing of a ball comprising:

obtaining first and second bands sized and configured for removable attachment to the forearms of a user's body, the first band being attached to an elongated, flexible, substantially inelastic, adjustable-length connector, attaching the second band to the connector to form a practice device, the second band being adjustably attached to provide the connector with an operating length appropriate to press against the user's body at or near the collar bone if the user moves both arms behind the plane of their pectoral muscles during wind-up for an overhand throwing of a ball, the operating length of the connector being configured to provide for an allowed angle of up to about 100 to about 120 degrees between the user's upper arms and forearms when extended in a horizontal plane, fastening the first and second bands to the right and left forearms of the user to position the connector in front of the user, obtaining a ball to practice with, and throwing the ball while utilizing the practice device, including winding up for an overhand throw by moving the forearms backwards in an amount sufficient to cause the connector to become straight, taut, and in contact with the user's body, the connector limiting the separation distance between the forearms of the user during wind-up.

2. The method of claim 1, wherein the connector that is attached to the first band comprises at least one of a strap and a cord.

3. The method of claim 1, wherein the first band is permanently attached to the connector.

4. The method of claim 1, comprising adjusting the operating length of the connector after fastening the first and second bands to the forearms of the user.

5. The method of claim 1, comprising adjusting the length of the connector by tying a knot in the connector.

6. The method of claim 1, wherein the connector has measurement indicia displayed thereon, further comprising adjusting the operating length of the connector to a predetermined length using the measurement indicia.

7. The method of claim 1, wherein the first and second bands are configured to be removably fastened to the right and left forearms of the user with fastening tape.

8. The method of claim 1, wherein the bands are configured to be disposed proximate the elbows of the user.

9. The method of claim 1 wherein the connector is configured to be mounted to the second band with a single double D fastener that is positioned on or adjacent to the second band.

10. The method of claim 2, wherein the first band is permanently attached to the connector.

11. The method claim 1, wherein the length of the connecter is adjustable to prevent scapular loading when the throwing trainer is worn by users of different sizes.

* * * * *